US011761710B2

(12) United States Patent
Hsieh

(10) Patent No.: US 11,761,710 B2
(45) Date of Patent: Sep. 19, 2023

(54) VAPOR CHAMBER STRUCTURE

(71) Applicant: ASIA VITAL COMPONENTS CO., LTD., New Taipei (TW)

(72) Inventor: Kuo-Chun Hsieh, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 0 days.

(21) Appl. No.: 18/098,179

(22) Filed: Jan. 18, 2023

(65) Prior Publication Data

US 2023/0152043 A1 May 18, 2023

Related U.S. Application Data

(63) Continuation of application No. 17/142,242, filed on Jan. 6, 2021.

(51) Int. Cl.
*F28D 15/04* (2006.01)

(52) U.S. Cl.
CPC ..... *F28D 15/04* (2013.01)

(58) Field of Classification Search
CPC ... F28D 15/04; F28D 15/046; H05K 7/20336; H05K 7/2029; H01I 23/427
See application file for complete search history.

(56) References Cited

U.S. PATENT DOCUMENTS 6,393,332 B1 * 5/2002 Gleditsch ..... G06Q 10/06 700/99
6,782,942 B1 * 8/2004 Wang ..... H01L 23/427 165/185
6,899,165 B1 * 5/2005 Wu ..... F28D 15/046 165/104.21
2004/0069460 A1 * 4/2004 Sasaki ..... F28D 15/046 165/104.21

(Continued)

FOREIGN PATENT DOCUMENTS

CN 1982826 A 6/2007
CN 207427663 U 5/2018

(Continued)

OTHER PUBLICATIONS

Search Report dated May 25, 2021 issued by Taiwan Intellectual Property Office for counterpart application No. 109142210.

(Continued)

*Primary Examiner* — Tho V Duong
(74) *Attorney, Agent, or Firm* — Demian K. Jackson; Jackson IPG PLLC

(57) ABSTRACT

A vapor chamber structure includes an upper plate, a lower plate, a middle layer and a polymer layer. The polymer layer is selectively connected with any of the upper and lower plates. The lower plate and the upper plate are mated with each other to together define a chamber. A working fluid is filled in the chamber. The middle layer is disposed in the chamber. The middle layer has a first face, a second face, (Continued)

multiple perforations and multiple channels. The multiple perforations pass through the first and second faces. The multiple channels are disposed on one of the first and second faces. By means of the above arrangement, the total thickness of the vapor chamber structure is equal to or smaller than 0.25 mm, whereby the vapor chamber can be extremely thinned.

4 Claims, 3 Drawing Sheets

(56) References Cited

U.S. PATENT DOCUMENTS

| | | | | |
|---|---|---|---|---|
| 2007/0068657 | A1* | 3/2007 | Yamamoto | H01L 23/427 165/80.4 |
| 2014/0345831 | A1* | 11/2014 | Lin | F28D 15/04 29/890.032 |
| 2016/0010926 | A1* | 1/2016 | Wang | F28D 15/046 29/890.032 |
| 2019/0285357 | A1* | 9/2019 | Sheng | F28D 15/0233 |

FOREIGN PATENT DOCUMENTS

| | | | |
|---|---|---|---|
| CN | 108534574 | A | 9/2018 |
| CN | 208480199 | U | 2/2019 |
| CN | 210862334 | U | 6/2020 |
| CN | 210892824 | U | 6/2020 |
| CN | 111750718 | A | 10/2020 |
| CN | 211651334 | U | 10/2020 |
| CN | 214095678 | U | 8/2021 |
| TW | I699507 | B | 7/2020 |
| TW | M608720 | U | 3/2021 |
| WO | 2006058494 | A1 | 6/2006 |
| WO | 2020223747 | A1 | 11/2020 |

OTHER PUBLICATIONS

Search Report dated Apr. 20, 2022 issued by China National Intellectual Property Administration for counterpart application No. 2020113872969.

* cited by examiner

VAPOR CHAMBER STRUCTURE

The present application is a continuation of U.S. patent application Ser. No. 17/142,242, filed on Jan. 6, 2021.

BACKGROUND OF THE INVENTION

1. Field of the Invention

The present invention relates generally to a vapor chamber, and more particularly to an extremely thin vapor chamber.

2. Description of the Related Art

In order to achieve better heat transfer effect, in the heat dissipation field, the heat dissipation device employing two-phase fluid heat exchange principle is used as the heat transfer component. In the heat dissipation devices, the vapor chamber and heat pipe are most often used. The vapor chamber and the heat pipe employ two-phase fluid heat exchange principle so that the main structures of the vapor chamber and the heat pipe must be made of a material with better heat conductivity, wherein copper is the most often seen material. The main body must have an internal vacuumed airtight chamber. Also, capillary structure is disposed on the wall face of the chamber and a working liquid is filled in the chamber. In the vacuumed environment, the boiling point of the working liquid is lowered and two-phase fluid (vapor and liquid) circulation can be carried out in the vacuumed airtight chamber to achieve better heat transfer efficiency.

A conventional vapor chamber has a main body composed of at least one plate body equipped with capillary structure and another plate body mated with the at least one plate body. Then the periphery of the main body is sealed and water (liquid working fluid) is filled into the chamber and the chamber is vacuumed to form the vapor chamber. The capillary structure in the vapor chamber mainly serves to make the liquid working fluid flow from the condensation section back to the evaporation section and store the liquid working fluid in the evaporation section. The capillary structure generally has the form of a sintered body, a mesh body, a fiber body and a channeled body, which is a structure capable of providing capillary attraction.

The sintered body is formed in such a manner that one face of the plate body is coated with metal powders. The metal powders are sintered and attached to the plate body to form a porous capillary structure. In the sintering process, each two adjacent powders are heated to a semi-molten state, whereby the powders are bonded with each other to form the porous capillary structure. In order to keep the capillary structure of the sintered powders with the property of porosity, the size of the sintered powders is limited. In the case that the size of the sintered powders is too small, after semi-molten, the sintered powders will nearly have no void therebetween. Under such circumstance, the sintered powders cannot form the porous capillary structure. That is, the capillary structure cannot provide any capillary attraction. Therefore, those fine sintered powders with too small size cannot be selectively used for the existing sintered body. Only those sintered powders with proper size can be sintered to form the capillary structure with voids between the powders to achieve capillary attraction. However, in this case, the sintered structure will be thickened. As a result, the conventional sintered body cannot be applied to an extremely thinned vapor chamber structure. Moreover, the current vapor chamber employing sintered body cannot be partially folded (bent). This is because after the vapor chamber is folded (bent), the sintered body in the chamber will be broken and destroyed to detach. This will lead to failure of the capillary structure on the plate body to lose the heat spreading and dissipation function.

Therefore, in order to solve the problem that the conventional sintered body cannot be applied to an extremely thinned vapor chamber structure, the manufacturers try to use the channeled structure with poorer capillary attraction or a mesh body or a woven mesh with capillary attraction smaller than the sintered powders as the capillary structure. The mesh body or the woven mesh can be conveniently arranged and applied to those parts, which need to be bent. However, when disposing the mesh body or the woven mesh in the vapor chamber, the mesh body or the woven mesh must be fully attached to the wall of the case or the pipe so that the mesh body or the woven mesh can provide capillary attraction for spreading the working liquid. In the case that the mesh body or the woven mesh fails to fully attach to the surface of the wall of the case or the pipe, no capillary attraction is provided for the working liquid to spread and carry out vapor-liquid circulation. Also, the mesh body and the woven mesh are mainly composed of multiple filament-shaped monomers, which intersect each other or which are woven with each other. Due to the limitation of the current processing machine and material, the diameter of each filament-shaped monomer (such as filament-shaped metal wire) can be hardly further minified. Therefore, the total thickness of the mesh body (or woven mesh) formed of the multiple filament-shaped monomers, which intersect each other or which are woven with each other cannot be further reduced. As a result, the conventional mesh body and woven mesh also cannot be applied to the extremely thinned vapor chamber structure.

Therefore, the manufacturers can only settle for the second best to employ the channeled structure with poorer capillary attraction. The channeled structure is formed in such a manner that the wall face of the case of the vapor chamber is mechanically processed to form the channeled structure as the capillary structure. However, this leads to another problem that when the wall face of the case of the vapor chamber is formed with the channeled structure, the wall of the case of the vapor chamber is also thinned. This will affect the structural strength of the entire vapor chamber so that it often takes place that the wall of the case of the vapor chamber is broken. In this case, the working liquid will leak out to lose the heat spreading and dissipation effect. When the wall face of the case of the vapor chamber is formed with the channeled structure, the wall of the case of the vapor chamber is thinned to weaken the structural strength of the entire vapor chamber. In the case that the vapor chamber is folded (bent), the section formed with the channeled structure is apt to break off. In consideration of the above problems, the manufacturers often quit using the channeled structure on the extremely thin vapor chamber.

Therefore, under the trend toward extremely thin vapor chamber, the total thickness of the vapor chamber is quite limited. The thickness of the wall of the case of the vapor chamber is limited to an extremely thin specification. Also, the internal airtight chamber and the capillary structure of the vapor chamber must be further minified. It can be known from the above that when designing the extremely thin vapor chamber, it is critical how to select and manufacture the capillary structure.

It is therefore tried by the applicant to provide a vapor chamber structure to solve the above problems existing in the conventional extremely thin vapor chamber. The vapor chamber structure can provide capillary attraction and is applicable to the extremely thin vapor chamber.

SUMMARY OF THE INVENTION

It is therefore a primary object of the present invention to provide a vapor chamber structure, which is applicable to extremely thin vapor chamber.

It is a further object of the present invention to provide the above vapor chamber structure, which has better capillary attraction and is foldable (bendable).

To achieve the above and other objects, the vapor chamber structure of the present invention includes an upper plate, a lower plate, a middle layer and multiple polymer layers. The upper plate is composed of multiple upper plate bodies, which are laminated with each other. The lower plate is composed of multiple lower plate bodies, which are laminated with each other. The upper plate has an upper outer face and an upper inner face, and the lower plate has a lower outer face and a lower inner face.

The lower plate and the upper plate are mated with each other to together define a chamber. A working fluid is filled in the chamber. The middle layer is disposed in the chamber. The middle layer has a first face, a second face, multiple perforations and multiple channels. The multiple perforations pass from the first face to the second face. The multiple channels are disposed on one of the first and second faces. The polymer layers are disposed and sandwiched between the multiple upper plate bodies and the multiple lower plate bodies. The total thickness of the vapor chamber structure is equal to or smaller than 0.25 mm.

By means of the present invention, the heat dissipation unit can be extremely thinned. In addition, the middle layer serves as the capillary structure for vapor-liquid circulation of the vapor working fluid and the liquid working fluid, whereby the shortcoming of the conventional heat dissipation unit that the vapor chamber cannot be extremely thinned is solved.

In the above vapor chamber structure, the polymer layers are sandwiched between the multiple upper plate bodies to form the upper plate and between the multiple lower plate bodies to form the lower plate.

The multiple channels are longitudinally or transversely or longitudinally and transversely to intersect each other formed on the second face of the middle layer.

The vapor chamber structure further includes a hydrophilic layer. The hydrophilic layer is selectively disposed on the upper inner face or the lower inner face or the second face of the middle layer and the surface of the multiple channels.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
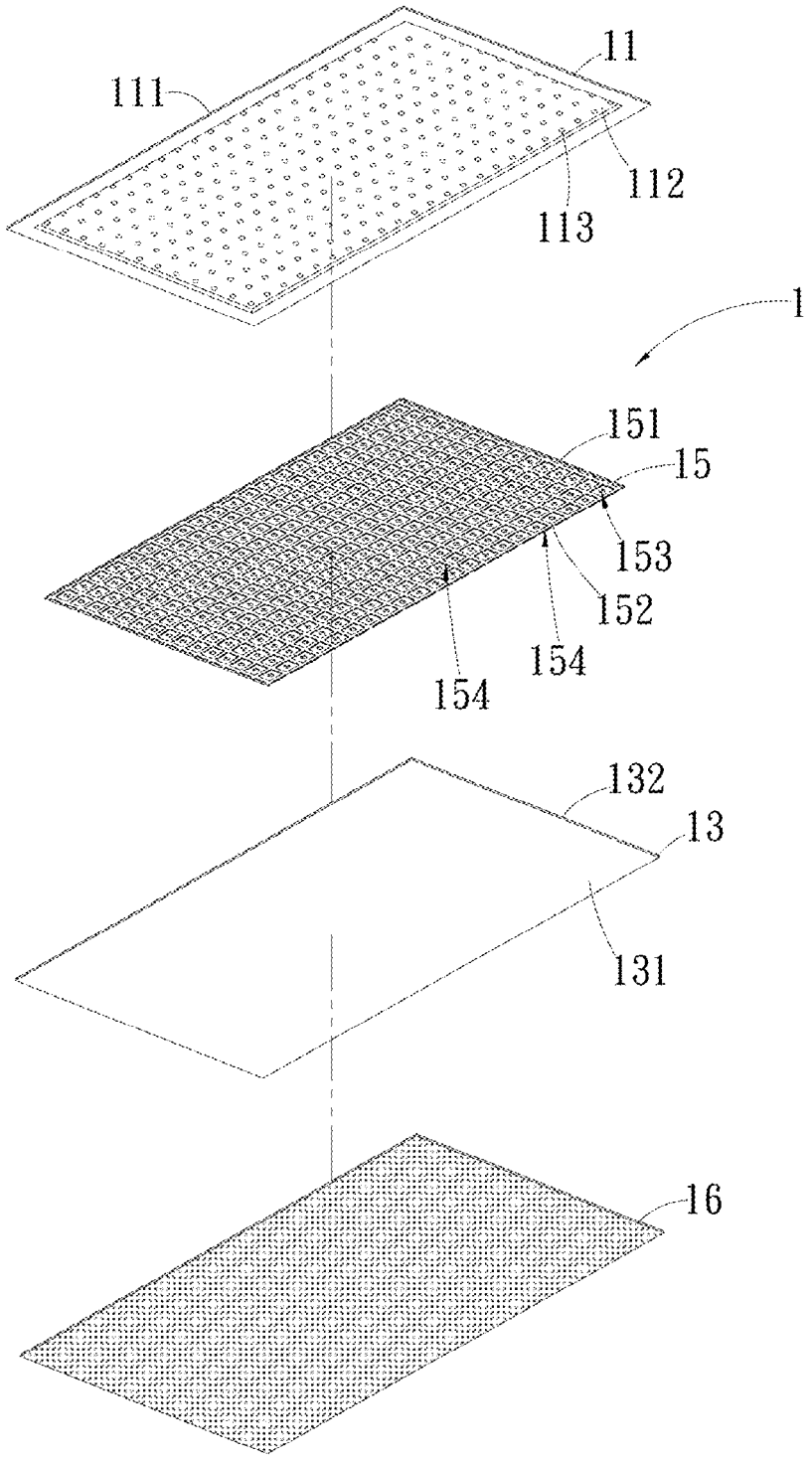
FIG. 1 is a perspective exploded view of a preferred embodiment of the vapor chamber structure of the present invention.
Figure 2:
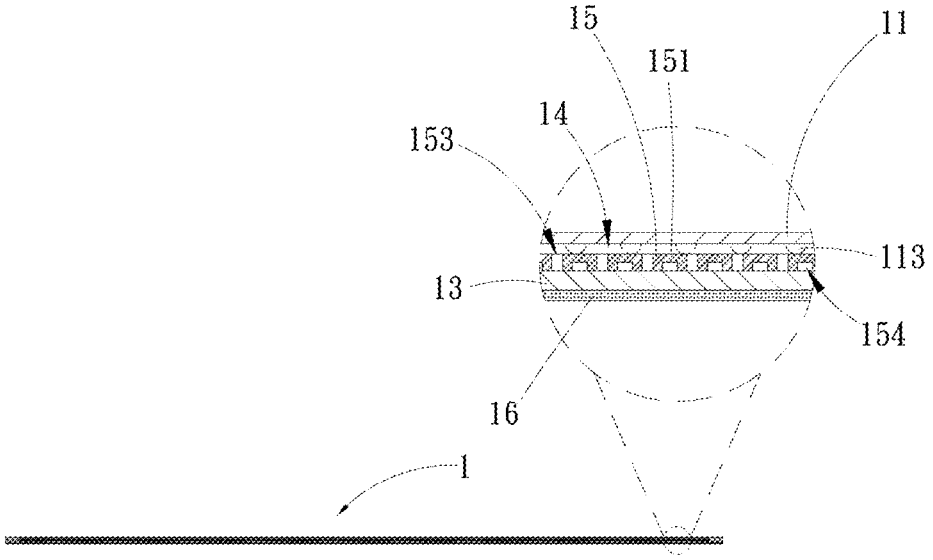
FIG. 2 is a sectional assembled view of the preferred embodiment of the vapor chamber structure of the present invention, in which the circled area is enlarged.

The present invention provides a vapor chamber structure. Please refer to FIGS. 1 and 2. FIG. 1 is a perspective exploded view of a preferred embodiment of the vapor chamber structure of the present invention. FIG. 2 is a sectional assembled view of the preferred embodiment of the vapor chamber structure of the present invention, in which the circled area is enlarged. The vapor chamber structure 1 of the present invention includes an upper plate 11, a lower plate 13, a middle layer 15 and a polymer layer 16. The upper plate 11 has an upper outer face 111, an upper inner face 112 and multiple bosses 113. The multiple bosses 113 are disposed on the upper inner face 112 and raised therefrom. The lower plate 13 has a lower outer face 131 and a lower inner face 132. The lower inner face 132 is opposite to the upper inner face 112. The lower plate 13 and the upper plate 11 are mated with each other to together define a chamber 14. A working fluid (such as pure water) is filled in the chamber 14. The upper plate 11 and the lower plate 13 are made of a material selected from a group consisting of copper, aluminum, stainless steel and commercial pure titanium. The thickness of the upper and lower plates 11, 13 is approximately 0.05 mm. In a preferred embodiment, the vapor chamber structure 1 can be alternatively a heat plate structure.

The middle layer 15 can be a sheet body or plate body disposed in the chamber 14. The middle layer 15 has a first face 151, a second face 152, multiple perforations 153 and multiple channels 154. The first and second faces 151, 152 are respectively correspondingly in contact and attachment with the lower inner face 132 and the multiple bosses 113. The multiple channels 154 are disposed on the first face 151 or the second face 152 or both the first and second faces 151, 152. In this embodiment, the multiple channels 154 are arranged and disposed on the second face 152 of the middle layer 15 at intervals. That is, the multiple channels 154 are longitudinally and transversely formed on the second face 152 of the middle layer 15 to intersect each other. The longitudinal channels 154 are in communication with the transverse channels 154. Accordingly, under the capillary attraction of the multiple channels 154, the liquid working fluid can quickly flow along the longitudinal and transverse channels 154 back to the lower inner face 132, (that is, the evaporation section). The thickness of the middle layer 15 is about such as 0.05 mm.

The multiple perforations 153 pass through the first and second faces 151, 152. The multiple perforations 153 and the multiple channels 154 are alternately arranged or not alternately arranged. In this embodiment, the multiple perforations 153 and the multiple channels 154 are, but not limited to, horizontally alternately arranged for illustration. Accordingly, by means of the design of the channels 154 formed on one face or both faces of the middle layer 15 and the perforations 153 passing through the middle layer 15 of the present invention, the multiple channels 154 are for the liquid working fluid to flow back and the multiple perforations 154 serve as vapor passages for the evaporated working fluid. Therefore, the present invention has the capillary structure with both the vapor circulation passages and the capillary attraction for making the liquid working fluid to flow back. This solves the problem that the capillary structure can be hardly disposed in the narrow internal chamber 14 of the thinned heat dissipation unit. Moreover, the middle layer 15 serves as a support structure for the vapor chamber structure 1 so that the chamber 14 of the vapor chamber structure 1 can keep complete without being squeezed and deformed to lose the vapor-liquid circulation function. In a modified embodiment, the multiple perforations 153 and the multiple channels 154 are vertically overlapped and alternately arranged. In another modified embodiment, the multiple channels 154 are transversely or longitudinally formed on the second face 152 of the middle layer 15.

The polymer layer 16 is such as artificial polymer (such as PE, PVC, Nylon, Dacron, ABS and SBR) or inorganic polymer (such as quartz, asbestos, mica or graphite). The polymer layer 16 is selectively connected with the upper plate 11 or the lower plate 13. The polymer layer 16 is selectively formed on the surface (such as the surface of the upper outer face 111, the surface of the upper inner face 112, the surface of the lower inner face 132 or the surface of the lower outer face 131) of the upper plate 11 or the lower plate 13 by means of painting, printing, adhesion or attachment. In this embodiment, the polymer layer 16 is formed on the surface of the lower outer face 131 of the lower plate 13 by means of painting. The total thickness of the vapor chamber structure 1 is, but not limited to, equal to 0.25 mm. In practice, the total thickness of the vapor chamber structure 1 can be smaller than 0.25 mm.

Figure 3:
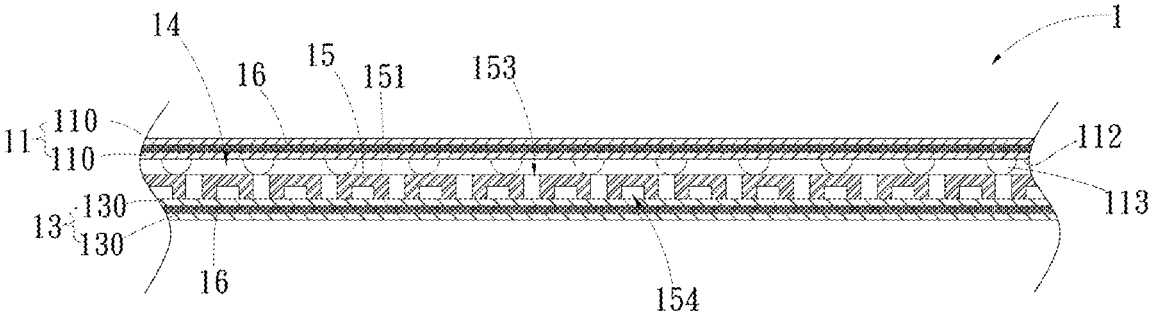
FIG. 3 is a sectional assembled view of another embodiment of the vapor chamber structure of the present invention.

FIG. 3 is a sectional assembled view of another embodiment of the vapor chamber structure of the present invention, and the structure is partially identical to the above embodiments and thus will not be redundantly described hereinafter. The embodiment is different from the above embodiments in that the polymer layer 16 is disposed and sandwiched between the upper plate 11 and/or the lower plate 13. In addition, the upper plate 11 (and/or the lower plate 13) are composed of multiple upper plate bodies 110 (and/or multiple lower plate bodies 130), which are laminated with each other.

In still another modified embodiment, the structure is partially identical to the above embodiments and thus will not be redundantly described hereinafter. The modified embodiment is different from the above embodiments in that the vapor chamber structure 1 further includes a hydrophilic layer. The hydrophilic layer is selectively disposed on the upper inner face or the lower inner face or the second face of the middle layer and the surface of the multiple channels.

In conclusion, the various capillary structures employed by the conventional techniques are applied to the extremely thin vapor chamber under limitation. Therefore, the vapor chamber can be hardly successfully thinned. According to the design of the vapor chamber structure 1 of the present invention, the total thickness of the vapor chamber structure 1 of the present invention is equal to or smaller than 0.25 mm. Therefore, the vapor chamber structure 1 of the present invention effectively improves the shortcoming of the conventional vapor chamber that in the thinning process, the capillary structure cannot be extremely thinned.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A vapor chamber structure comprising:

an upper plate being composed of multiple upper plate bodies, which are laminated with each other, the upper plate having an upper outer face and an upper inner face;

a lower plate being composed of multiple lower plate bodies, which are laminated with each other, the lower plate having a lower outer face and a lower inner face, the plate and the upper plate being mated with each other to together define a chamber, a working fluid being filled in the chamber;

a middle layer disposed in the chamber, the middle layer having a first face, a second face, multiple perforations and multiple channels, the multiple perforations passing through the first and second faces, the multiple channels being disposed on at least one of the first and second faces; and multiple polymer layers disposed and sandwiched between the multiple upper plate bodies and the multiple lower plate bodies, whereby the total thickness of the vapor chamber structure is equal to or smaller than 0.25 mm.

2. The vapor chamber structure as claimed in claim 1, wherein the multiple channels are longitudinally and transversely formed on the second face of the middle layer to intersect each other.

3. The vapor chamber structure as claimed in claim 1, wherein the multiple channels and the multiple perforations are alternately arranged.

4. The vapor chamber structure as claimed in claim 1, wherein the upper plate has multiple bosses, the multiple bosses being disposed on the upper inner face of the upper plate and raised therefrom, the second face of the middle layer being attached to the multiple bosses.

* * * * *